United States Patent [19]

Perfect

[11] 4,085,845

[45] Apr. 25, 1978

[54] CONTAINER AND UTILITY TRAY

[75] Inventor: Alan J. Perfect, Allentown, N.J.

[73] Assignee: Johnson & Johnson, New Brunswick, N.J.

[21] Appl. No.: 641,001

[22] Filed: Dec. 15, 1975

[51] Int. Cl.[2] ..... B65D 1/36; B65D 85/62

[52] U.S. Cl. ..... 206/564; 206/45.19; 206/363; 206/804; 229/2.5 R

[58] Field of Search ..... 206/72, 75, 45.19, 45.14, 206/363, 804, 45.2, 564; 229/2.5, 15

[56] References Cited

U.S. PATENT DOCUMENTS

| | | | |
|---|---|---|---|
| 3,013,656 | 12/1961 | Murphy, Jr. | 206/72 |
| 3,061,089 | 10/1962 | Higgins | 206/45.19 |
| 3,135,383 | 6/1964 | Bloch | 206/75 |
| 3,182,420 | 5/1965 | Bender | 206/45.14 |
| 3,232,397 | 2/1966 | McCoy | 206/45.2 |
| 3,565,321 | 2/1971 | Weiss | 229/15 |
| 3,620,367 | 11/1971 | Stemble | 229/2.5 |

*Primary Examiner*—William T. Dixson, Jr.

[57] ABSTRACT

A combination container and utility tray in which a tray is supported in and secured to an outer container. The interrelationship of the tray and the container together with the design of the tray is such as to permit the tray to be thermally formed of otherwise unacceptably thin sheet material thus saving in amount of materials used with resulting reduction in manufacturing costs while still providing a convenient and firm support for shipping and use of articles.

The firmness of support is achieved by forming around the periphery of the tray a downwardly extending flange and forming in the main body of the tray a plurality of depressions for holding different objects with some of the depressions having a depth such that the bottom of the depression is in the same plane as the edge of the downwardly extending flange. The tray is held in a cardboard container having a bottom and sides, the cardboard container being only slightly larger than the tray so that the downwardly extending flange of the tray contacts the sides of the container with the bottom of the deeper depressions resting on the bottom of the container and being secured thereto.

The tray, which is designed for storing and holding articles used in tooth treatment including stacked mixing trays and fluid containing vials, is formed with specially designed depressions for these articles. The depressions for the stacked mixing trays have an access through the side of the tray with their bottoms being secured to the bottom of the container. The depressions for the vials are in the form of wells each having a shallow portion, which fits the outer contour of the vial when in a prone position and a deeper portion which fits the contour of the base of thevial and is adapted to support the vial in an upright position.

8 Claims, 7 Drawing Figures

CONTAINER AND UTILITY TRAY

DESCRIPTION OF THE INVENTION

The present invention is drawn to a container and utility tray for packaging and supporting a variety of articles in such manner as not only to protect the same during handling and shipping but also to arrange and support the articles in an attractive and convenient manner so that the same are readily accessible during use.

There are various activities which require the use of numerous miscellaneous items. One such activity is the treatment of teeth by a dentist with polymerizable materials for forming a protective coating thereon.

From the dentist's viewpoint it is important to have the materials and items needed readily accessible and, particularly where polymerizable compositions are used which require disposable items in their use, to also have a sufficient number of such disposable items at hand and correctly placed. Accordingly, where a kit is assembled for use by a dentist the various items making up the kit should preferably not only be attractively displayed but the items should also be so dispersed that the same are conveniently accessible to the dentist when working with the same. Attractiveness and convenience of arrangement are only part of the aspects of good packaging. The articles must also be supported and protected during shipping and storage so that they are in good condition and still properly arranged with respect to each other when the container is opened.

Packaging can be extremely important with respect to the overall attractiveness and convenience of use of the materials packaged. It is one of the objects of the present invention to achieve these desirable characteristics, while keeping packaging cost to a minimum. The present invention is directed to preparing such a package while reducing packaging costs by economizing on the amount of packaging material used.

In packaging items it is conventional practice to thermoform a sheet of thermal-plastic material to form a supporting tray with indentations being formed in the sheet for holding the various items to be packaged. It is important that such a tray have substantial rigidity and strength to properly protect and support the items during shipping. Heretofore, most such trays were used primarily for holding articles during shipping without consideration of the same being used for conveniently presenting the articles during use. In accordance with the present invention the tray is so formed and the tray is supported by the outer container in such manner that the tray itself is given substantial rigidity through the manner in which it is formed and associated with the outer shipping container. This permits the tray to be formed of substantially thinner thermoplastic sheet material than would otherwise be necessary providing substantial savings with respect to materials while still giving more than adequate support.

There is thus provided in accordance with the present invention a combination container and utility tray comprising an outer container having sides and a bottom, a tray formed of relatively thin flexible material supported by the container and secured thereto, the tray having a downwardly extending flange with the width of the flange being greater than the width of the sides of the container and the downwardly extending flange contacting the sides of the container. The tray has a plurality of depressed areas formed therein for holding articles to be used. At least one of the depressed areas is positioned near one side of the tray and has an access thereto through the downwardly extending flange with the bottom of the depressed area being on the same plane as the edge of the flange and the bottom of the depressed area being secured to the bottom of the container. At least one other of the depressed areas is in the form of a well designed for holding a vial. The well has a shallow portion and a deep portion. The shallow portion of the well has substantially the same configuration as that of the upper portion of the vial and the deep portion of the well has substantially the same configuration as that of the lower portion of the vial whereby the vial may be supported in a prone position in the shallow portion of the well and in an upright position in the deep portion of the well and raised from its prone position to its upright position by pressure on the lower portion of the vial.

The combination container and utility tray of the present invention is best described by referring to the drawings in which.

Figure 1:
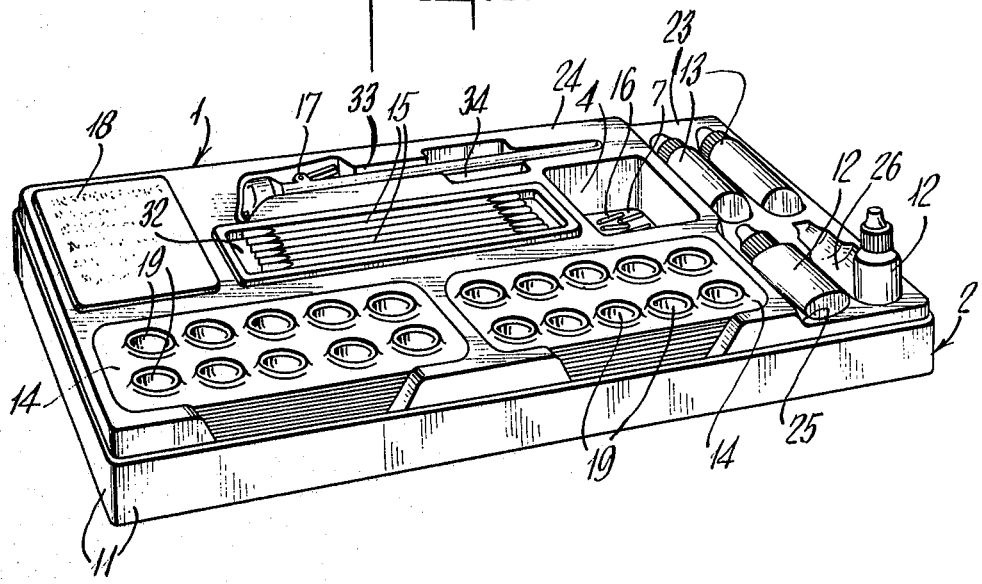
FIG. 1 is a perspective view of the tray as supported in the outer container with its contents ready for use.
Figure 2:
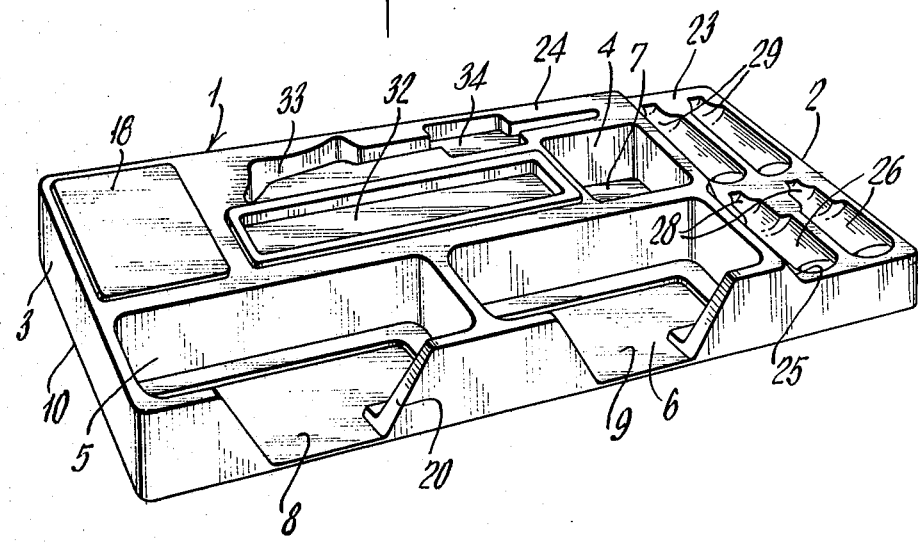
FIG. 2 is a perspective view of the tray of FIG. 1 prior to placing in the outer container.
Figure 3:
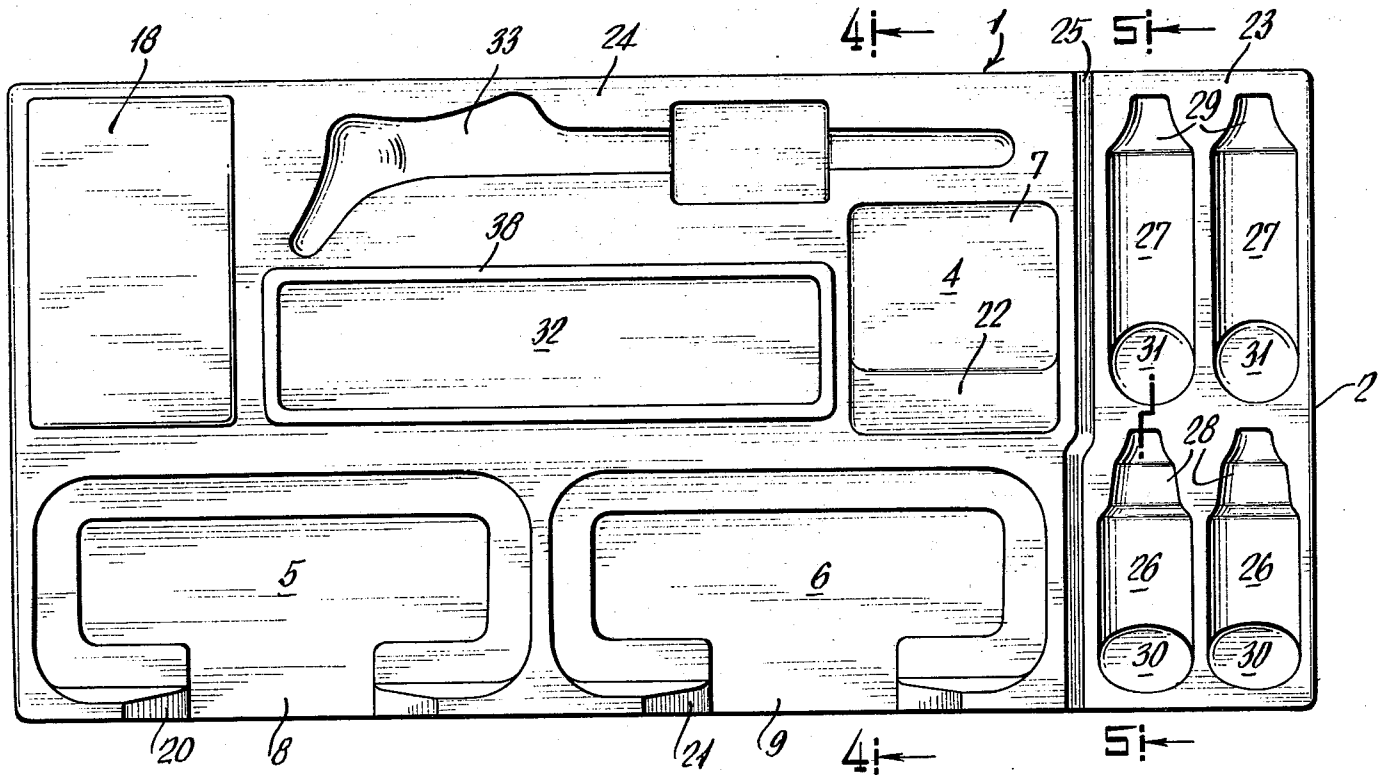
FIG. 3 is a top plan view of the tray of FIG. 2.
Figure 5:
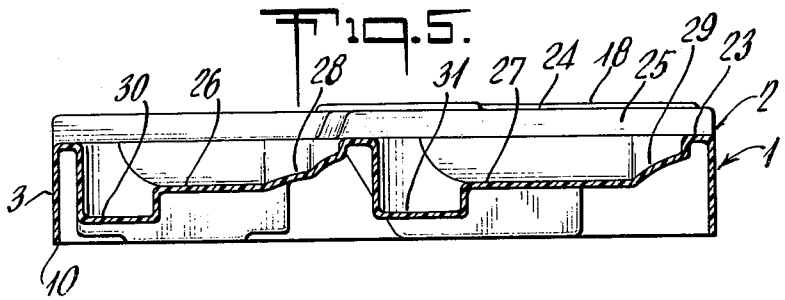
FIG. 5 is a cross-sectional view taken along 5—5 of FIG. 3.
Figure 4:
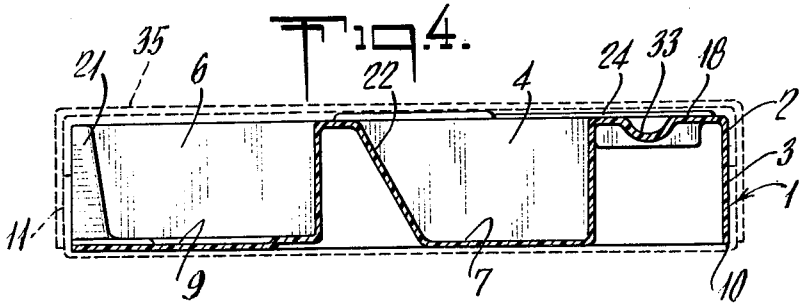
FIG. 4 is a cross-sectional view taken along line 4—4 of FIG. 3 but with outer container in dotted lines.
Figure 6:
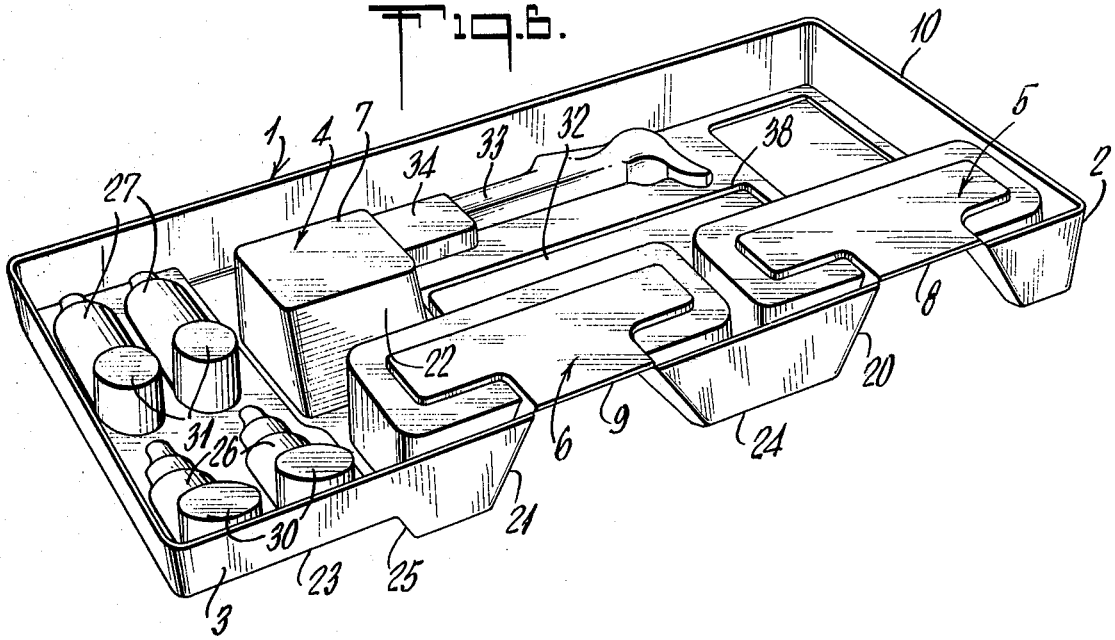
FIG. 6 is a perspective view of the bottom of the tray.
Figure 7:
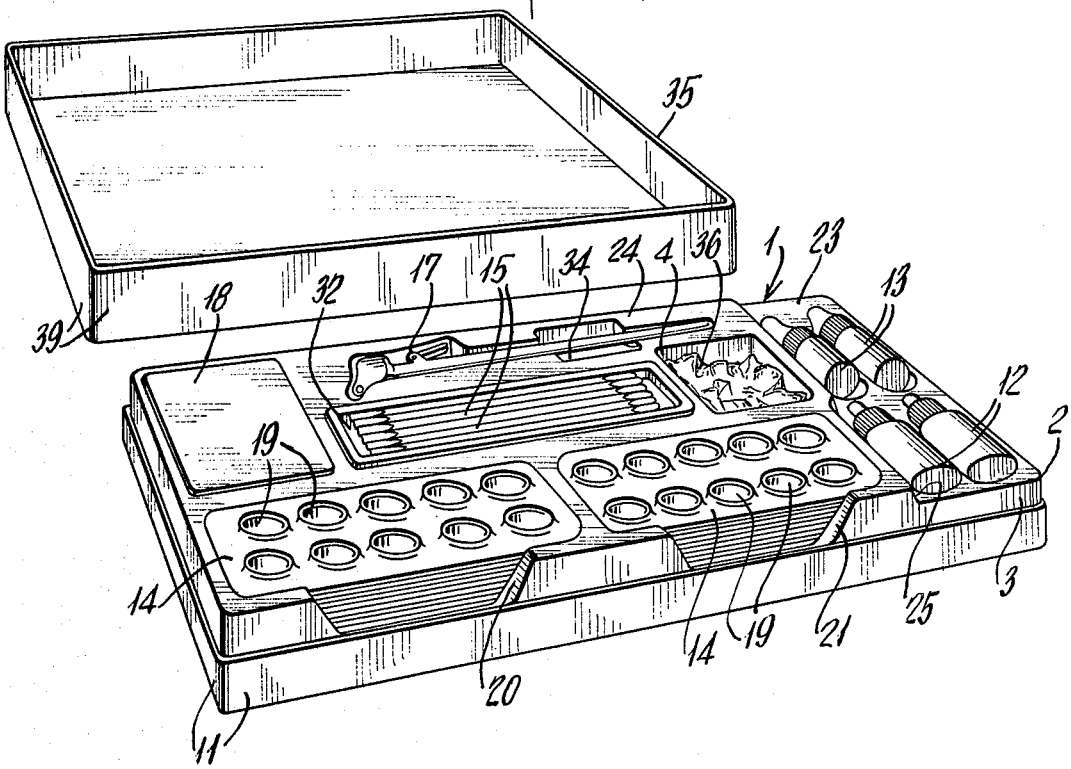
FIG. 7 is a perspective view of the combination container and tray with contents when first opened.

Referring to FIGS. 1 and 7, there is illustrated a tray 1, which is thermoformed from thermoplastic sheet material and supported in an outer container 2. The cover 35 of container 2, which has been removed, as illustrated in FIG. 7 together with the combination container and tray.

The preferred form of cover 35 is one in which the sides 39 overlap the sides 40 of the container 2 when the cover is placed over the container for closing the same. Such an arrangement not only provides added strength with resulting protection in shipping but also makes overwrapping of the closed container easier where the same is overwrapped and sealed in a plastic film or the like.

As illustrated in FIGS. 1 and 7, the tray, 1, is filled with the various items that would be used by a dentist in the coating of teeth with a protective polymer film to fill and cover pits and fissures that may be present.

The thermoformed tray 1, is best illustrated in FIGS. 2 through 6, where the same is shown empty of contents and prior to its insertion into, and securing to, container 2. Referring to these figures, it will be noted that the thermoformed tray 1, has a downwardly extending side flange 3 and several relatively deep depressions 4, 5 and 6. The depressions 4, 5 and 6 are all of equal depth and their respective bottom portions 7, 8 and 9 are in the same plane as the outer edge 10 of the downward extending flange 3. Thus, when the tray 1 is placed on a flat surface, such as the bottom of container 2, the outer edge 10 of the flange and the bottom portions 7, 8 and 9 of these depressions will contact the flat surface, giving substantial support to the tray.

The outer dimensions of tray 1 are slightly less than the inner dimensions of the container 2 so that when the tray is placed in the container 2, as illustrated in FIGS. 1 and 7, the container is supported laterally through contact of its downwardly extending flange 3 with the sides 11 of container 2. This further increases the stability of the tray 1. The outer surface of the depression bottoms 7, 8 and 9 are adhesively secured to the bottom of the container 2, thus forming a unitary firm structure.

In the particular tray illustrated the tray is designed for shipping, and supporting while in use, items used by a dentist in the pit and fissure treatment of teeth. These include polymerizable catalyst containing monomer stored in vials 12, polymerizable activator containing monomer stored in vials 13, mixing trays 14, applicator sticks 15, applicator tips 16, and an applicator 17. These items are supported in appropriate depressions formed in the tray 1 for holding the same. Also, directions for their use are contained in a direction plate 18 provided in the upper left-hand corner of the tray for convenience to the dentist. During shipping, the applicator tips 16, are contained in a plastic bag 36 so as to keep the tips restrained in depression 7. When the contents are prepared for use the plastic bag 36 is discarded and the tips, which are in the form of relatively short tubes, are stored in depression 7 where they are readily accessible for use.

In preparing the treating composition and applying the same to the tooth of a patient, the dentist places a few drops of monomer from one of the vials 12, in one of the indentations 37 of the mixing tray 14 and places some of the monomer from one of the vials 13 in the same indentation. The dentist then removes one of the mixing sticks 15 with which he mixes the monomers on mixing tray 14. A disposable applicator tip 16 is removed from depression 4 and placed in the end of applicator 17. Using the applicator 17 the mixed monomer is drawn up into the disposable tip 16 and then applied to the patient's tooth while the monomer mix is still fluid and prior to its polymerization. As the monomer from vial 12 contains a catalyst and the monomer from vial 13 an activator, the monomers polymerize a few minutes after mixing. Accordingly, the disposable tip 16, after use is then removed and discarded as is the disposable mixing tray 14.

For the convenience of the dentist and ready accessibility, the disposable mixing trays 14 are contained in depressions 5 and 6 which are in the front portion of the tray 1. The flange on side of the tray in this front portion is open at 20 and 21 for giving ready access to the depressions 5 and 6 so that a disposable tray 14 contained therein, once used, can be easily removed and discarded.

Depression 4, for holding the disposable tips 16 has three substantially perpendicular sides with the fourth side 22, which is the one closest to the front of the tray, formed so as to slope upwardly towards the front of the tray. With this construction an applicator tip can easily be removed from the depression 4 by drawing it forward along the sloping side 22.

The portion of the tray designed for holding the vials, 12 and 13, has an upper surface, 23, stepped down from the upper surface 24 of the remainder of the tray. This not only improves the overall aesthetics of the tray 1 but also adds appreciably to its rigidity by forming a cross-brace or truss 25 resulting from the double bend of the sheet material forming the tray in this area.

Where the cover used for the container is designed to extend down over the sides of the container, which may be done for further strengthening the same, the stepped surface arrangement has a still further advantage in that it aids in opening the container. Pressure on the cover in the portion extending over the stepped down portion of the tray causes the cover to tilt so that the opposite edge of the cover becomes more readily accessible for grasping. Such tipping is prevented during shipping by an overwrap not shown, which may be of clear plastic or other material. This wrap holds the cover firmly in place until removed.

In order to add to the convenience in using the vials, 12 and 13, while still protecting the same in shipping, the depressions 26 and 27 in which they are stored are specially designed. The depressions 26 for vials 12 and depressions 27 for vials 13 are in the form of wells each having an upper shallow portion and a lower deep portion. The shallow portion which is designated as 28 in depressions 26 and as 29 in depressions 27 have substantially the same configuration as that of the outer configuration of the upper portion of the vials to be contained therein while the lower deep portions, designated as 30 for depressions 26 and 31 for depressions 27 have a configuration corresponding to that of the bottom portion of the respective vials to be contained therein. When monomer is to be removed from a vial, the vial is readily raised to its upright position by pressing on the lower portion of the vial. This forces the lower portion into the deeper part of the depression thus raising the vial which then slips into this deeper part where it is held in an upright position for ready removal by the dentist.

Depression 32 is a relatively shallow depression placed generally centrally in the raised portion of the tray. This depression is designed for holding the mixing sticks 15. A raised ridge 38 is provided around depression 15 to prevent the mixing sticks 37 from spilling out of depression 15 during shipping of the container. When the cover 35 is placed over the tray 1 to close the container the raised ridge 38 bears against the inner surface of the cover 35 to form a seal and prevent displacement of the sticks. Depression 33, which is designed for holding the applicator 17, has an enlarged portion 34 for entrance of the fingers of the dentist so that the applicator can be readily grasped and removed. Depression 33 is also a shallow depression so as to hold the applicator close to the surface of the tray 1 so that it can be readily grasped by the dentist for easy removal as needed.

By positioning the various items on the tray 1 in the manner described the same as readily accessible to the dentist and are also so positioned with respect to each other that the tray itself serves as a working base for conveniently holding and mixing ingredients during tooth treatment.

Although the combination container and utility tray described is designed primarily for holding and using items making up a dental kit for the treatment of pits and fissures, several features in the tray construction are of more general application and can be readily used in the packaging and dispensing of other materials, the same all forming a part of the present invention.

Having thus described my invention, I claim:

1. A combination container and utility tray comprising an outer container having sides and a bottom, a tray formed of relatively thin flexible material supported by said container and secured thereto said tray having a downwardly extending flange around the periphery thereof the width of said flange being greater than the width of the sides of said container and said downwardly extending flange contacting the sides of said container, said tray having a plurality of depressed areas formed therein for holding articles to be used, at least one of said depressed areas being positioned near one side of said tray and having an access thereto through said downwardly extending flange the bottom of said depressed area being on the same plane as the edge of said flange and the bottom of said depressed area being secured to the bottom of said container, and at least one of said depressed areas being in the form of a well designed for holding a vial having an upper portion and a lower portion with said well having a shallow portion and a deep portion the shallow portion of said well having substantially the same configuration as that of the upper portion of said vial and the deep portion of said well having substantially the same configuration as that of the lower portion of said vial whereby the vial may be supported in a prone position in the shallow portion of said well and in an upright position in the deep portion of said well and raised from its prone position to its upright position by pressure on the lower portion of said vial.

2. A container and utility tray of claim 1 in which some of said depressed areas are designed for holding articles other than vials and have a depth less than the width of said flange.

3. A container and utility tray of claim 1 in which at least one of said depressed areas has a depth equal to the width of said flange and has no access through the side of said tray said depressed area having three substantially perpendicular sides and one sloping side.

4. A container and utility tray of claim 3 in which the sloping side of said depressed area slopes upwardly towards the side of said tray which contains the access through the downwardly extending flange.

5. In a utility tray formed of relatively thin flexible material and having front and rear portions a downwardly extending peripheral flange, supporting depression adapted to contain articles and help support said tray the bottoms of said supporting depressions being on the same plane as the edge of said flange with the bottoms of said supporting depressions and the edge of said peripheral flange adapted to rest on any flat surface on which said tray may be placed, at least one of said supporting depressions being positioned in the front portion of said tray with access thereto through said flange, another of said supporting depressions being more centrally located with respect to said flange and having no access therethrough said other of said supporting depressions having three substantially perpendicular sides and one sloping side with the sloping side sloping towards the side of said tray for easy removal of items therefrom, and a plurality of wells adapted to hold vials each well having a shallow portion and a deep portion the shallow portions of said wells having substantially the same configuration as that of the upper portion of a vial to be contained therein and the deep portion of said well having substantially the same configuration as that of the lower portion of said vial to be contained therein whereby the vial may be supported in a prone position in the shallow portion of said well and in an upright position in the deep portion of said well and raised from its prone position to its upright position by pressure on the lower portion of said vial.

6. A utility tray of claim 5 in which the upper surface is stepped with the upper surface on one end of said tray being lower than the upper surface on the other end of said tray and said wells for containing vials being formed in that portion of said tray having the lower upper surface.

7. In a tray for holding a vial which vial has an upper portion and a lower portion a well having a shallow portion and a deep portion the shallow portion of said well having substantially the same configuration as that of the upper portion of said vial and the deep portion of said well having substantially the same configuration as that of the lower portion of said vial and being located at the opposite end of said well away from said shallow portion.

whereby the vial may be supported in a prone position in the shallow portion of said well and in an upright position in the deep portion of said well and raised from its prone position to its upright position by pressure on the lower portion of said vial.

8. A combination vial and a tray for holding said vial, said tray including a well having a shallow portion and a deep portion, said shallow portion having a configuration corresponding to the upper part of said vial, and said deep portion having a configuration corresponding to the bottom portion of said vial, said deep portion being located at the opposite end of said well away from said shallow portion; and said vial being supported in a prone position in the shallow portion of said well and in an upright position in the deep portion of said well, whereby said vial may be raised from its prone position to its upright position by pressure on the lower portion of said vial.

* * * * *